United States Patent [19]

Dietrich et al.

[11] Patent Number: 4,620,427

[45] Date of Patent: Nov. 4, 1986

[54] TRANSPORT DEVICE ON AN APPARATUS FOR LETTING OUT SKINS

[75] Inventors: Herbert Dietrich; Günther Mall, both of Kaiserslautern, Fed. Rep. of Germany

[73] Assignee: Pfaff Industriemaschinen GmbH, Fed. Rep. of Germany

[21] Appl. No.: 711,408

[22] Filed: Mar. 13, 1985

[30] Foreign Application Priority Data

Mar. 17, 1984 [DE] Fed. Rep. of Germany ..... 3409943

[51] Int. Cl.[4] ..... C14B 17/00

[52] U.S. Cl. ..... 69/47; 69/40

[58] Field of Search ..... 69/27, 44, 49, 22, 40; 112/49

[56] References Cited

U.S. PATENT DOCUMENTS 4,416,125 11/1983 Dietrich ..... 69/47 X

*Primary Examiner*—Wm. Carter Reynolds

*Attorney, Agent, or Firm*—McGlew & Tuttle

[57] ABSTRACT

An apparatus for letting out skins comprises behind the parting sword a needle bar movable up and down which is movable in addition parallel to the drawoff direction of the skin through a drive mechanism. Together with a supporting plate movable up and down, the needle bar acts on the skin section already let out so that it is held taut and flat.

4 Claims, 13 Drawing Figures

TRANSPORT DEVICE ON AN APPARATUS FOR LETTING OUT SKINS

FIELD AND BACKGROUND OF THE INVENTION

This invention relates in general to sewing machines and in particular to a new and useful device for letting out skins which includes an arrangement of transport needles for effecting the easy feeding and removal of the skins as they are operated on in a sewing procedure.

An apparatus for letting out skins is disclosed in German Pat. No. 31 13 836 (U.S. Pat. No. 4,416,125). The apparatus comprises, in order along the draw-off direction of the skin before the parting sword, two needle bars, and behind the parting sword, one needle bar. Together the needle bars movable up and down form a holding device for the skin resting on two table boards. During the letting out process, in which the skin is parted slantwise to its lateral edges, cut, and the skin portions are offset to each other and then sewn together again, the skin is held by two clamping jaws cooperating like pliers and movable relative to each other in longitudinal directions. After the sewing, the skin is seized at the outer edge of the seam by a gripping tool movable upwardly and downwardly as well as transversely to the parting sword in a horizontal plane; and, for executing the next letting out process, it is shifted on the table boards crosswise to the parting sword and hence crosswise to the same direction.

It has now been found that the skin section already let out tends to roll up because of the seams arched in rib fashion, so that there is danger that the parting sword will during its upward movement, seize the previously formed seam. This would result in irregular distances between cuts.

SUMMARY OF THE INVENTION

The invention provides an apparatus for letting out skins which assures that the skin section already let out cannot be seized by the parting sword.

By the needle bar, connected with a drive mechanism and movable parallel to the draw-off direction of the skin, there is exerted on the already let-out skin section, during the transport process executed by the gripping tool and occurring crosswise to the parting sword, a draw-off force supporting this transport process, and it is thereby avoided that the gripping tool rolls up the already let-out skin or pushes it together into a wave form. After the completed transport process, the supporting plate is moved upward, whereby it places itself against the skin section present between the gripping tool and the needle bar and holds it flat. It is thereby assured that the skin section already let out will not be seized by the parting sword and hence cannot be damaged and also exactly equal cut distances between the individual skin strips are obtained.

The pivoting of the needle bar about an axis transverse to the draw-off direction makes it possible in conjunction with a supporting plate section of matching arcuate form in the pivot region of the needle bar to bring the already let-out skin section into a downwardly directed position, whereby the drawing off of the skin is additionally supported and the tendency of the let-out skin to roll up is counteracted.

The use of the spring to move the needle bar in the draw-off direction makes it superfluous to synchronize the draw-off movement of the needle bar with the movement of the gripping tool as to time and as to path or respectively to adapt them to one another. In addition, after completed pushing movement of the gripping tool, the needle bar can exert a traction on the skin section between them, whereby the action of the supporting plate is supported and the respective skin section is held flat additionally.

A variant of the invention makes it possible to securely grip and transport the skin both immediately after it has been placed on and after the first letting out, the skin being carried before the first letting out by a horizontally displaceable base plate and after the first letting out it is carried by two vertically movable supporting plates.

Accordingly it is an object of the invention to provide an improved means for removing a skin in a let-out sewing procedure.

A further object of the invention is to provide an apparatus for handling skins in an apparatus for letting out skins which is simple in design, rugged in construction and econimcal to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
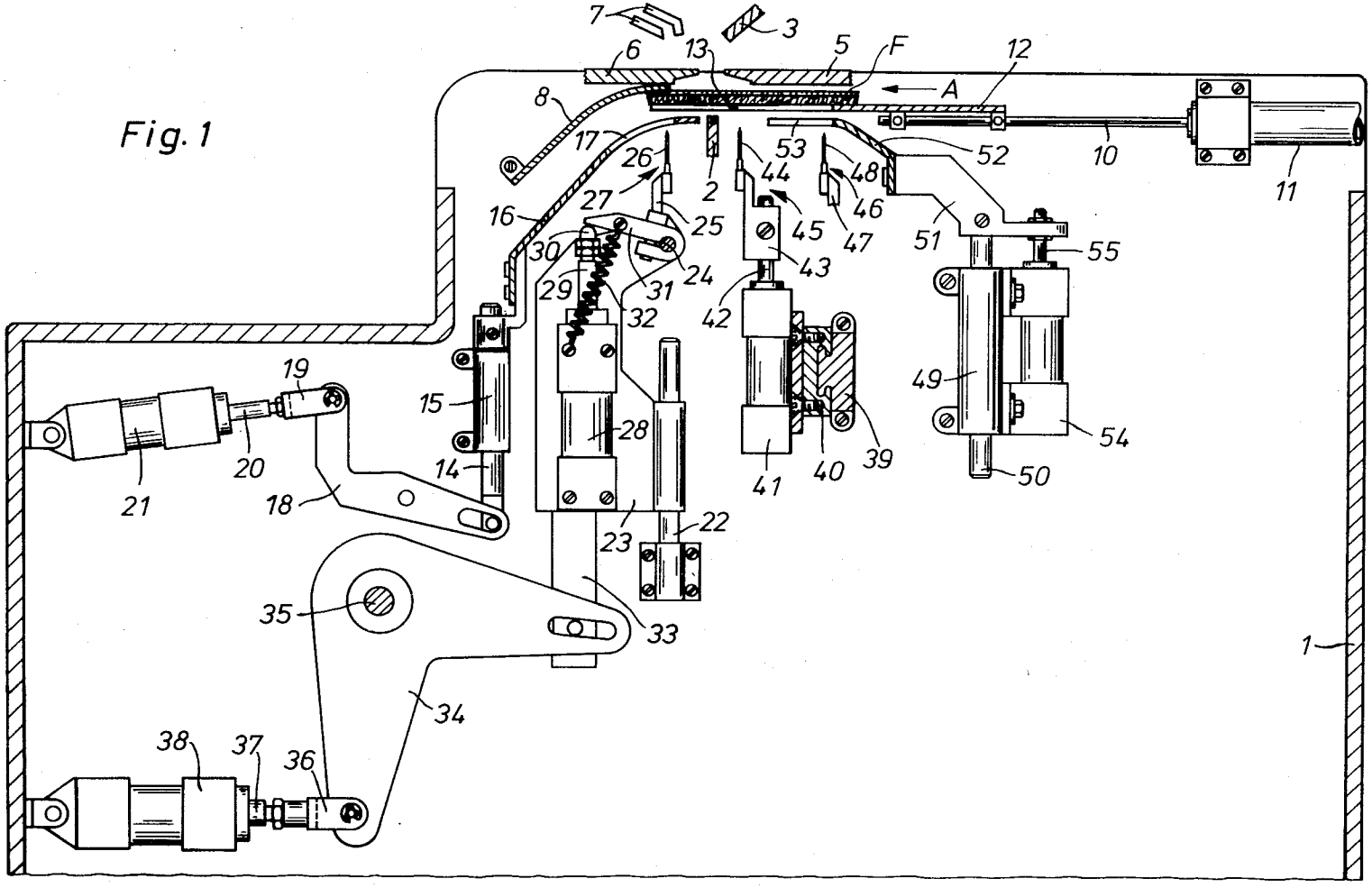
FIG. 1 is a sectional view of a part of the apparatus for letting out skins, constructed in accordance with the invention.

Referring to the drawings in particular the invention embodied therein comprises an apparatus for improving the handling of a skin during a let-out sewing procedure in which after the skin is clamped by two clamping jaws, the skin is sewn by a sewing machine needle thereafter drawn off in a feed direction.

The apparatus corresponds partially in general design to the apparatus illustrated and described in German Pat. No. 31 13 836. Arranged in a frame or housing 1 is a parting sword 2 shown in transverse section, which is displaceable in longitudinal direction as well as movable up and down by a mechanism(not shown). Associated with the parting sword 2 is an elongated hold-down 3 extending parallel thereto, which by means not shown is movable from the position set back obliquely and raised as shown in FIG. 1 toward the parting sword 2 and simultaneously lowerable.

Figure 7:
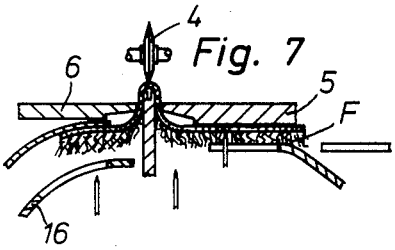

The apparatus comprises a cutting device movable up and down by means (not shown) as well as displaceable parallel to the parting sword 2, of which a circular cutting knife 4 is shown in FIG. 7. With respect to the draw off direction of the skin F marked by the arrow A, the apparatus contains a front clamping jaw 5 and a rear clamping jaw 6. Like the corresponding clamping jaws of the apparatus according to the above-mentioned patent, both clamping jaws 5 and 6 are movable forward and back by means not shown, in a horizontal plane crosswise or transverse to the longitudinal direction of the parting sword 2. The rear clamping jaw 6 is moreover displaceable, by means also not shown, in a horizontal plane parallel to the longitudinal direction of the parting sword 2.

Above the clamping jaws 5 and 6, a gripping tool 7 is arranged which, by means not shown, is movable like the gripping tool of the apparatus according to the above-mentioned patent, up and down as well as crosswise and parallel to the longitudinal direction of the parting sword 2.

Below the rear clamping jaw 6, on frame 1, there is a deflector 8 which has an arcuate upper portion and a lower obliquely extending portion. A horizontal base plate 12 is secured on the piston rod 10 of a compressed air cylinder 11 mounted on the frame 1. The base plate 12 has several successive slits 13 extending parallel, of which only one is shown.

A supporting plate 16 is disposed below the deflector 8, on a slide rod 14 which is received in bearing blocks 15 mounted on frame 1. The supporting plate 16 has an arcuate in the upper portion and extends obliquely downwardly at its lower end. The supporting plate 16 has several successive, parallel slits 17, of which only one is visible.

The slide rod 14 is articulated to an angle lever 18 pivotably mounted on the frame 1. The angle lever 18 is articulated to a forked head 19 which is fastened to the piston rod 20 of a pneumatic cylinder 21 pivotably arranged on frame 1.

Two carrying plates 23 spaced from each other are arranged displaceably on two slide rods 22 attached on frame 1. An elongated carrier 25 is fastened on a shaft 24 mounted in the carrying plates 23 and it is provided with a plurality of needles 26. The carrier 25 and the needles 26 form a needle bar 27. At one of the carrying plates 23 a compressed air cylinder 28 is fastened, whose piston rod 29 is provided with a pressure piece 30. The pressure piece 30 cooperates with a lever 31 secured on shaft 24. An extension spring 32, fastened to the cylinder 28 at one end and to the lever 31 at the other end, holds lever 31 in abutment on the pressure piece 30. A rod 33, articulated to an angle lever 34, is fastened to each of the carrying plates 23. The angle levers 34 are fastened on a common shaft 35 mounted in frame 1. One of the angle levers 34 is articulated to a forked head 36 which is attached to the piston rod 37 of a compressed air cylinder 38 pivotably arranged on frame 1.

On a guide track 39 secured to frame 1 and running parallel to the parting sword 2 a slide 40 carrying a compressed air cylinder 41 is displaceably arranged. On the piston rod 42 a carrier 43 is fastened, which is provided with a plurality of needles 44. Carrier 43 and the needles 44 form a needle bar 45. Spaced from needle bar 45 an additional needle bar 46 is arranged which is formed by a carrier 47 and a plurality of needles 48 and by means not shown is movable, like the corresponding needle bar of the apparatus according to the abovementioned patent, up and down and during upward movement of the parting sword 2 is displaceable cross wise to the longitudinal direction of the parting sword 2.

Arranged in a bearing block 49 is fastened on frame 1 is a slide rod 50 at whose upper end a carrier 51 is fastened. At the carrier 51 a supporting plate 52 is arranged, which in a horizontally extending section has several successive slits 53 open at one end, of which only one is visible. Fastened on the bearing block 49 is a compressed air cylinder 54, whose piston rod 55 is firmly connected with the carrier 51.

Figure 8:
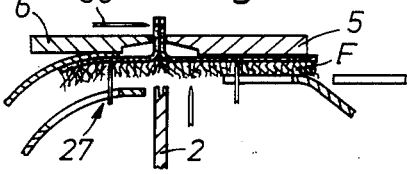

Like the apparatus according to the aforesaid patent, the apparatus comprises a sewing machine movable parallel to the longitidunal direction of the parting sword 2, of which only the needle 56 is shown in FIG. 8.

Figure 2:
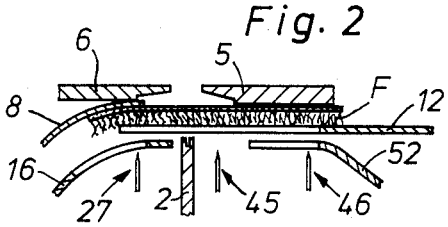
FIGS. 2 to 13 are sectional views of the apparatus showing successive work phases.
Figure 3:
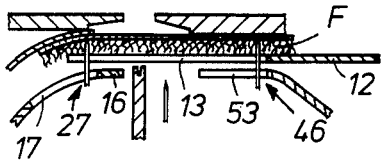
Figure 4:
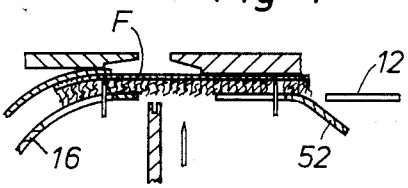

The apparatus works as follows:

Before the placing on of a skin F to be let out, the supporting plate 16, 52 and the needle bars 27, 45, 46 are lowered and the base plate 12 is in the advanced position shown in FIG. 1. The skin F to be let out is now placed hair side down onto the base plate 12 according to FIGS. 1 and 2. Thereafter the needle bars 27 and 46 are moved upward, the needles 26 projecting through the slits 17 and 13 and the needles 48 through the slits 53 and 13 and piercing the skin F according to FIG. 3. The skin F having been fixed by the needle bars 27,46, the base plate 12 is retracted into its inoperative position shown in FIG. 4 and immediately thereafter the supporting plates 16 and 52 are moved upward, whereupon the skin F now rests on the supporting plates 16 and 52.

Figure 5:
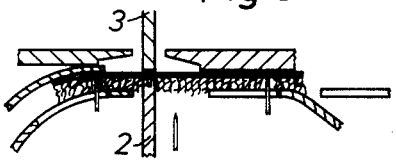
Figure 6:
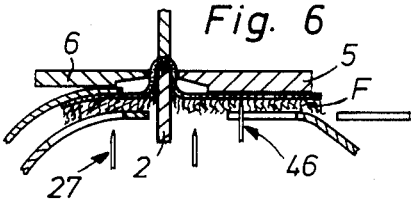

Thereafter the first letting out operation is carried out, wherein first the parting sword 2 is, as shown in FIG. 5, moved upward and the hold-down 3 is lowered. The parting sword 2 then parts the skin hairs in the same manner as described in the aforesaid patent. After the parting operation the needle bar 27 is lowered and, as shown in FIG. 6, the parting sword 2 is raised so far that the skin section clamped between the parting sword 2 and the hold-down 3 protrudes over the top side of the clamping jaws 5, 6. During this upward movement of the parting sword 2, the needle bar 46 is displaced according to the stroke of the parting sword 2 horizontally in the direction thereof, whereby it is avoided that the skin F can pull askew during the upward movement of the parting sword 2.

As soon as the upward movement of the parting sword 2 is ended, the clamping jaws 5,6 are moved toward each other and the skin F is clamped against the parting sword 2. Thereafter the holddown 3 is removed, the skin F is cut in two by the cutting knife 4 (FIG. 7) and the supporting plate 16 is lowered. Now the backspacing described in detail in the aforesaid patent takes place, in that the rear clamping jaw 6 is displaced parallel to the longitudinal direction of the parting sword 2. Thereby the rear skin portion is moved along the parting sword 2, being offset laterally relative to the front skin portion. Subsequently the needle bar 27 is lifted again until the needles 26 stab into the skin F, and the parting sword 2 is lowered, whereupon the clamping jaws 5,6 press the edge sections of the skin strips against one another. Then the edge sections of the skin strips are sewn together again (FIG. 8).

Figure 9:
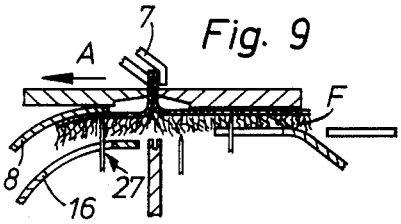

After the sewing together, the gripping tool 7 seizes the protruding seam edge (FIG. 9) and the previously extended piston rod 29 of the compressed air cylinder 28 is retracted, whereby the pressure piece 30 moves away from the lever 31. As a result, the extension spring 32 exerts a force on the needle bar 27 via lever 31 by which the skin section present between the deflector 8 and the supporting plate 16 is tensioned in arrow direction A.

Figure 10:
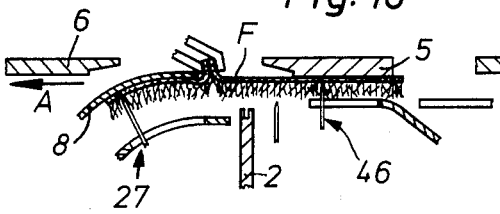

Thereafter the front clamping jaw 5 is pulled back by a small amount and the rear clamping jaw 6 by a greater amount, whereupon the gripping tool 7 is lowered to remove the fold previously formed in skin F by the parting sword 2. In so doing, the spring-loaded needle bar 27 pulls out in arrow direction A the portion of the fold toward the rear clamping jaw 6 and being released as the gripping tool 7 descends, in that the needle bar 27 is pivoted by the extension spring 32 about the axis of shaft 24. Simultaneously, with the gripping tool 7 also the needle bar 46 is lowered. Thereafter the gripping tool 7 is moved according to FIG. 10 by the amount of the desired cut distance crosswise to the longitudinal direction of the parting sword 2. During this transport movement of the gripping tool 7, the spring-loaded, downwardly pivoting needle bar 27 exerts on the portion of skin F present under the deflector 8 a traction supporting the transport movement of the gripping tool 7 whereby this skin section is held taut.

Figure 11:
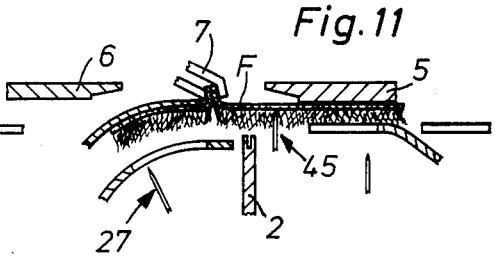

After ended transverse movement of the gripping tool 7, the carrying plates 23 together with the needle bar 27 are moved downward, the needles 26 being pulled out of the skin F, while the needle bar 45 is moved upward until the needles 44 pierce the skin F. Subsequently the gripping tool 7 is displaced parallel to the longitudinal direction of the parting sword 2 to carry out the return movement of skin F described in the aforesaid patent. During the longitudinal movement of gripping tool 7,the needle bar 45 is moved along synchronously with the gripping tool 7 (FIG. 11).

After bringing back of the skin F, the supporting plate 16 is moved upward again, whereby the skin section let out and provided with a seam is pressed against the deflector 8 and thereby held flat. At the same time the needle bar 27 is again pivoted into the vertical position by the piston rod 29 being extended, whereupon it is moved upward together with the needle bar 46.

Figure 12:
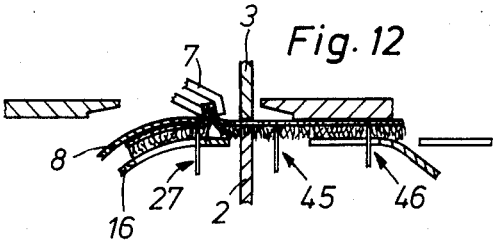
Figure 13:
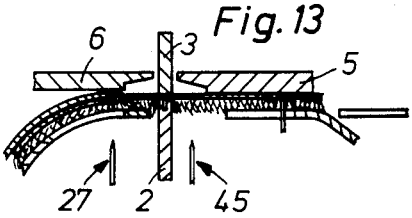

While the gripping tool 7 continues to grip the skin F at the seam protrusion and all three needle bars 27, 45, 46 are inserted into the skin F, thereby gripping it too, the parting sword 2 is raised and the hold-down 3 lowered to carry out the next parting operation (FIG. 12). After the parting, the gripping tool 7 is opened and moved into an inoperative position away from the skin F and the rear clamping jaw 6 is moved in the direction of the front clamping jaw 5, whereupon both present an equal spacing from the hold-down 3. Simultaneously the needle bars 27 and 45 are lowered (FIG. 13). Thereafter the parting sword 2 is, as shown in FIG. 6, moved upward for the formation of a fold in skin F, whereupon the steps already described take place in the same sequence for the execution of the second letting-out operation.

While specific embodiments of the invention have been shown and described in detail to illustrate the application of the principles of the invention, it will be understood that the invention may be embodied otherwise without departing from such principles.

What is claimed is:

1. In an apparatus for letting out skins in which a base plate on which the skin is placed is advanced with the skin below two separable clamping jaws and a parting sword is moved upwardly to engage one side of the skin which is engaged on its opposite side by a hold-down so that the parting sword in the hold-down move together upwardly with the skin between the clamping jaws when they are separated and in a manner such that the folded over skin will be positioned by the parting sword in alignment with a sewing needle for sewing, the improvement comprising a support plate below the skin onto which the skin is fed having an upper curved portion with a slot, a needle bar, at least one skin penetrating needle connected to said needle bar and engageable through the skin to move the skin, drive means connected to said needle bar for moving said needle bar to move said skin penetrating needle for upward and downward movement and for movement off in a transverse drawoff direction and through the slot of said support plate, and means connected to said support plate for moving said support plate upwardly and downwardly and in a manner alternating with the upward and downward movement of said skin penetrating needle.

2. In an apparatus for letting out skins in which a base plate on which the skin is placed is advanced with the skin below two separable clamping jaws and a parting sword is moved upwardly to engage one side of the skin which is engaged on its opposite side by a hold-down so that the parting sword in the hold-down move together upwardly with the skin between the clamping jaws when they are separated and in a manner such that the folded over skin will be positioned by the parting sword in alignment with a sewing needle for sewing, the improvement comprising a support plate below the skin onto which the skin is fed having an upper curved portion with a slot, a skin penetrating needle engageable through the skin to move the skin, means mounting said needle for upward and downward movement and for movement off in a transverse drawoff direction and through the slot of said support plate, and means for moving said support plate upwardly and downwardly, said needle being pivotal about an axis extending transverse to the drawoff direction.

3. In an apparatus for letting out skins in which a base plate on which the skin is placed is advanced with the skin below two separable clamping jaws and a parting sword is moved upwardly to engage one side of the skin which is engaged on its opposite side by a hold-down so that the parting sword in the hold-down move together upwardly with the skin between the clamping jaws when they are separated and in a manner such that the folded over skin will be positioned by the parting sword in alignment with a sewing needle for sewing, the improvement comprising a support plate below the skin onto which the skin is fed having an upper curved portion with a slot, a skin penetrating needle engageable through the skin to move the skin, means mounting said needle for upward and downward movement and for movement off in a transverse drawoff direction and through the slot of said support plate, said means for moving said needle comprises a drive mechanism for moving said needle upwardly and downwardly and for displacing said needle in a horizontal plane, said needle being pivotally mounted, spring means for urging said needle to rotate about said pivot in a drawoff direction, said means for moving said needle upwardly and downwardly comprising a fluid pressure operated piston and cylinder combination.

4. In an apparatus for letting out skins in which a base plate on which the skin is placed is advanced with the skin below two separable clamping jaws and a parting sword is moved upwardly to engage one side of the skin which is engaged on its opposite side by a hold-down so that the parting sword in the hold-down move together upwardly with the skin between the clamping jaws when they are separated and in a manner such that the folded over skin will be positioned by the parting sword in alignment with a sewing needle for sewing, the improvement comprising a support plate below the skin onto which the skin is fed having an upper curved portion with a slot, a skin penetrating needle engageable through the skin to move the skin, means mounting said needle for upward and downward movement and for movement off in a transverse drawoff direction and through the slot of said support plate, a base plate mounted below said clamping jaws and means for moving said base plate backwardly and forwardly so as to position a skin thereon in respect to said clamping jaws, a support plate located below said base plate and the skin, and means for moving said support plate upwardly and downwardly.

* * * * *